US005425212A

United States Patent [19]

Menchetti

[11] Patent Number: 5,425,212

[45] Date of Patent: Jun. 20, 1995

[54] FOLDING TRACK

[75] Inventor: Robert J. Menchetti, Buffalo, N.Y.

[73] Assignee: National Gypsum Company, Charlotte, N.C.

[21] Appl. No.: 121,471

[22] Filed: Sep. 16, 1993

[51] Int. Cl.[6] ..... E04C 3/02

[52] U.S. Cl. ..... 52/731.7; 52/79.5; 52/658; 52/730.6; 16/226

[58] Field of Search ..... 52/730.6, 731.7, 730.1, 52/480, 98, 79.5, 658, 631, 731.5, 731.9; 16/225, 226, DIG. 13

[56] References Cited

U.S. PATENT DOCUMENTS 3,462,765 8/1969 Swanson ..... 16/225
3,551,940 1/1971 Edison ..... 16/225
4,056,904 11/1977 Dawdy ..... 52/98
5,010,709 4/1991 Paz ..... 52/98
5,079,884 1/1992 Menchetti ..... 52/241

*Primary Examiner*—Carl D. Friedman
*Assistant Examiner*—Laura A. Saladino
*Attorney, Agent, or Firm*—Marshall, O'Toole, Gerstein, Murray & Borun

[57] ABSTRACT

A foldable floor track or ceiling track having ⅛-inch-wide slots in the flanges and a ⅛-inch-high rib in the web, between the slots, permitting the track to be cleanly folded in half at the factory, for convenient packaging and handling, and then unfolded and fastened to the floor and the ceiling at a job site.

15 Claims, 2 Drawing Sheets

FOLDING TRACK

This invention relates to sheet metal channels and more particularly to a folding track for use as a structural unit, such as a floor track or ceiling track.

BACKGROUND OF THE INVENTION

Sheet metal channels, consisting of a horizontal web and two vertical flanges, and referred to as floor track, are commonly affixed to a floor in the process of constructing a wall. A second channel, referred to as a ceiling track, may also be affixed to a ceiling, directly over the floor track. Metal studs are then placed to extend vertically from within the floor track channel to within the ceiling track channel. Wallboard is then screwed to the vertical studs, which are located every 16 inches or 24 inches, along the length of the tracks.

Metal studs and metal track are very common in commercial construction. Home construction has most commonly employed wood 2×4's, but the use of metal studs and tracks in homes is increasing. Changes in metal studs and metal track which will make their use more appealing to do-it-yourself builders are clearly desirable.

SUMMARY OF THE INVENTION

The present invention consists of a folding metal track, in which the two vertical flanges each have a ⅛-inch-wide slot cut out of them at the middle of the track, and a small raised rib formed in the web between the two slots. The slots and rib permit the track to be cleanly folded in half at the factory and then unfolded and fastened to a floor at a job site.

This novel track is particularly useful when combined with extendible studs, such as those disclosed in U.S. Pat. No. 5,079,884, or any other form of extendible stud, since the extendible stud makes it possible to package and ship 4½-foot stud sections for constructing 8-foot walls. Nine-foot-long sections of folding track can also be packaged in 4½-foot-long packages. Nine-foot-long sections of track are easier to align and install than multiple shorter sections of track.

Extendible studs are short lengths of stud framing which can be combined by the user to adjust to a wide range of ceiling heights without having to be cut to fit. The 4½-foot lengths of folded track would match the projected length of extendible studs intended to fit a typical 8-foot-high residential wall. Folded track can thus be bundled along with the extendible studs. An appropriate amount of folded track can be included which would be needed for use in combination with the number of extendible studs included in the bundle. This package would be easier for a do-it-yourselfer to load and transport in an automobile than 8-foot- and 9-foot-long products.

It is an object of the invention to provide a more easily handled sheet metal channel.

It is a further object to provide improved folding tracks for structural floor tracks and ceiling tracks.

It is a still further object to provide a novel improved package of folding track and extendible studs for delivering and constructing the framing for walls.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

Figure 1:
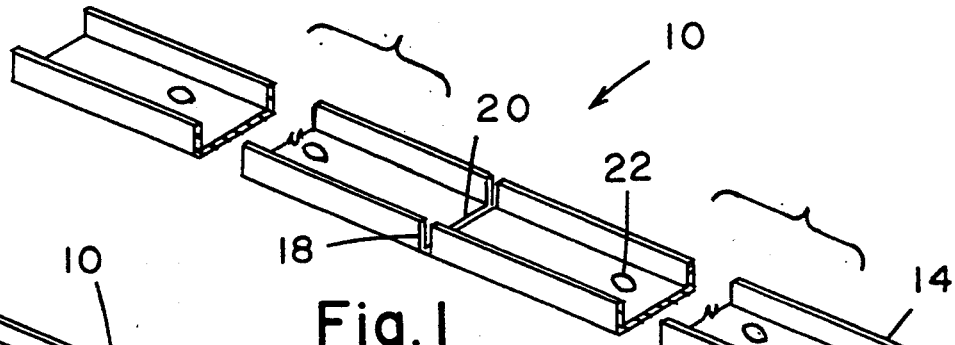
FIG. 1 is an isometric view of a nine-foot-long section of folding track.
Figure 2:
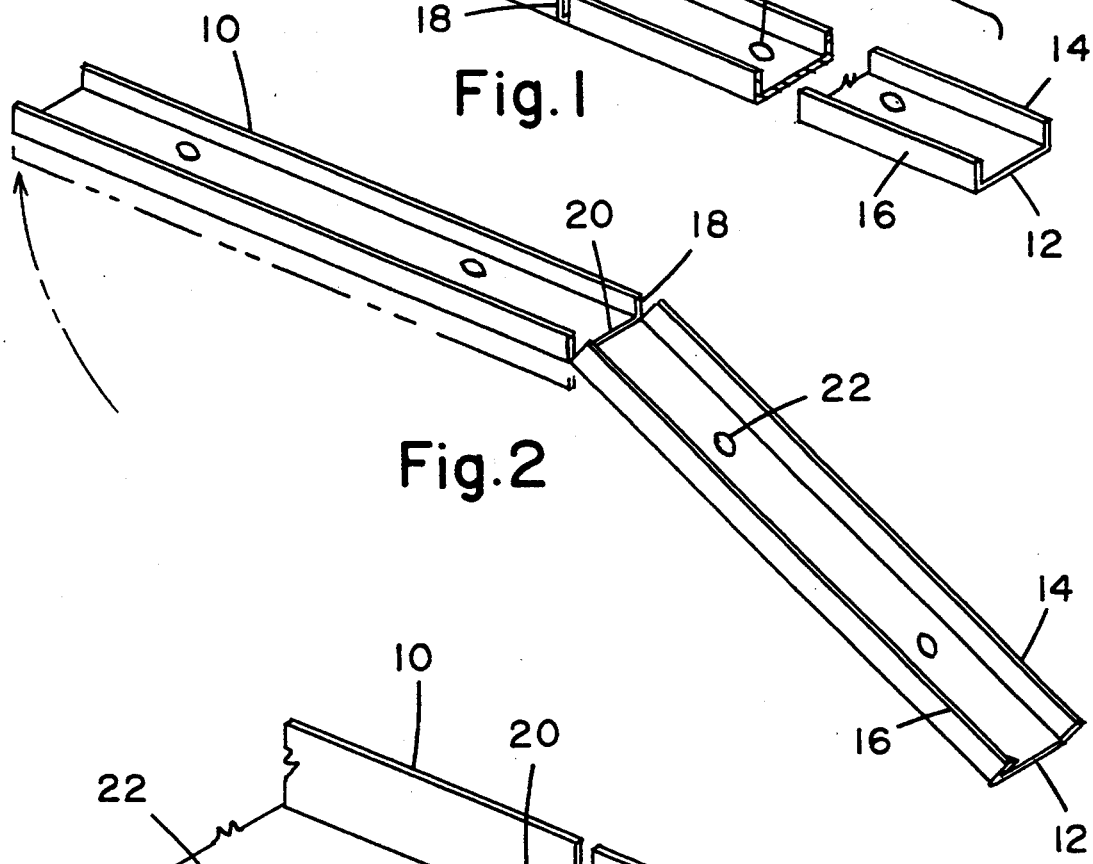
FIG. 2 is an isometric view of the folding track of FIG. 1 as it is being folded, and, in phantom, the right half of the track folded beneath the left half.

Referring to FIGS. 1 and 2, there is shown a 9-foot length of folding track 10, suitable for use as a floor track, forming the base of 9 feet of wall. Folding track 10 is essentially a sheet metal channel including an elongate web 12 and elongate flanges 14 and 16, extending perpendicularly from each edge of web 12. Web 12 is about 3½ inches wide and flanges 14, 16 are about 1-inch high.

Figure 3:
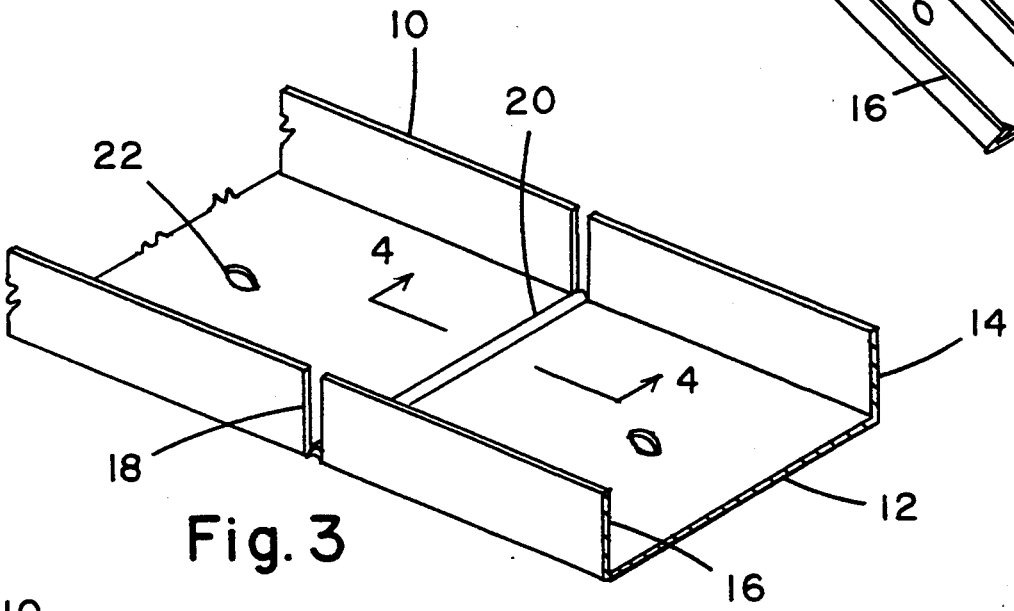
FIG. 3 is an isometric view of the center portion of the folding track of FIG. 1.
Figure 4:
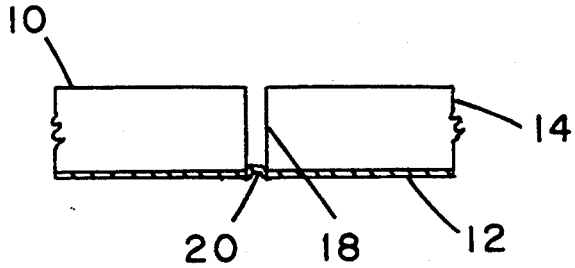
FIG. 4 is a sectional view of the center portion of the folding track of FIG. 3, taken on line 4—4.

Each flange 14 and 16 has a ⅛-inch-wide slot 18 cut out, at the center of the 9-foot length, and web 12 has a slightly raised rib 20 extending between the two slots 18, all best seen in FIGS. 3 and 4. The rib 20 is about ⅛-inch wide, equal to the width of slots 18, and is about ⅛-inch high.

Subsequent to manufacture of the folding track 10 of FIGS. 1, 3 and 4, it is folded along rib 20, as shown in FIG. 2.

The rib 20 is preferably pressed into web 12 prior to the web 12 being folded, whereby the track 10 can be cleanly folded at the factory and then unfolded and fastened to a floor at a job site. A plurality of holes 22 are located along the centerline of the web 12, for fastening the track 10 to a floor.

Figure 5:
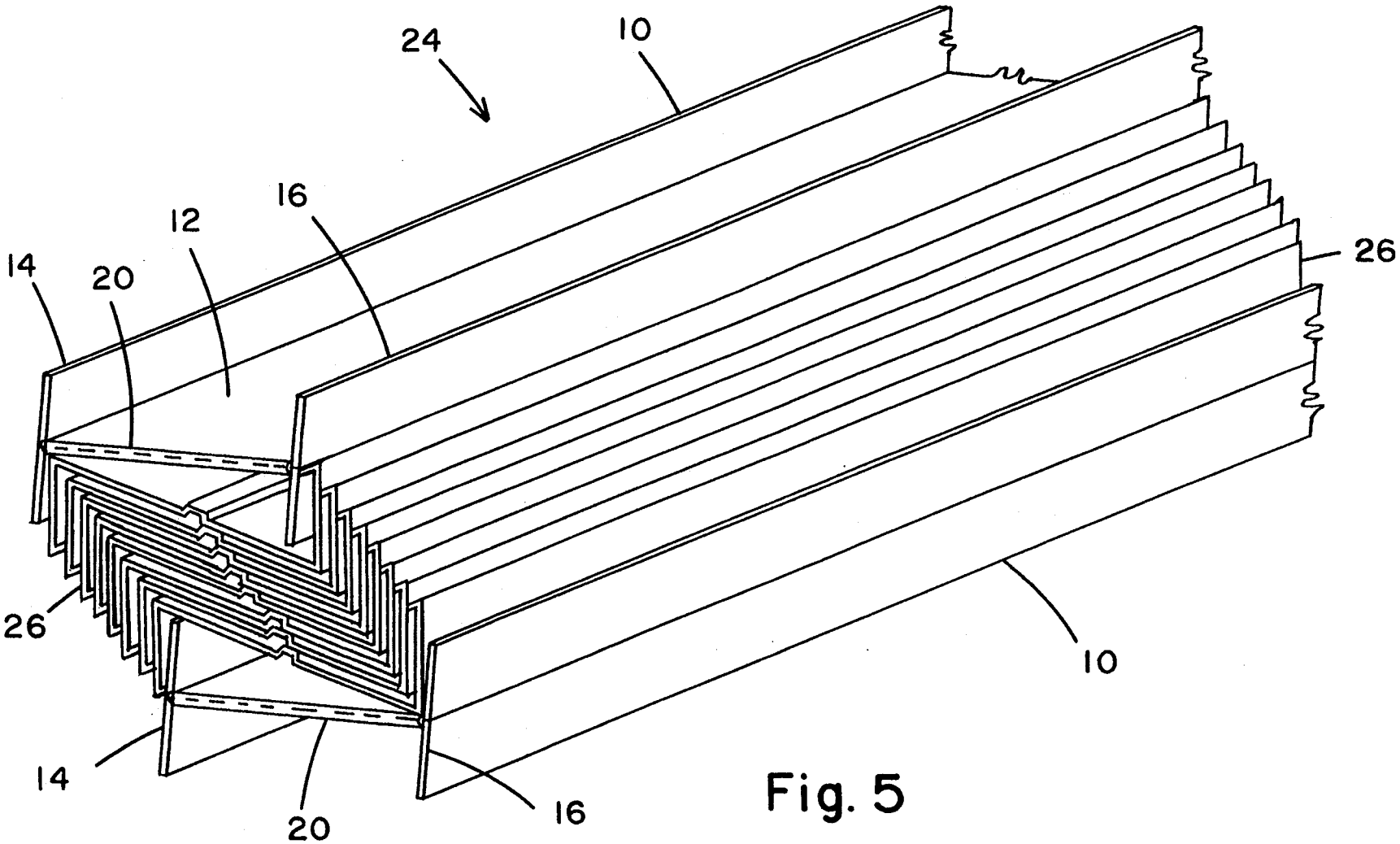
FIG. 5 is an isometric view of the folding track of FIG. 2, folded and placed together with a plurality of 4½-foot, extendible stud sections, to be used therewith.

Track 10 may be fastened to a floor by rivets, as shown in U.S. Pat. No. 5,079,884, on "Extendible Interconnected Z-Studs", which patent is incorporated herein by reference. Track 10 is particularly adapted to be packaged, sold, transported and ultimately assembled together with extendible interconnected studs, such as the Z-studs of patent 5,079,884, since both can be transported in 4½-foot-long packages for constructing a 9-foot-long, 8-foot-high hollow wall framework. FIG. 5 shows a package 24 consisting of two folded folding tracks 10 and eight 4½-foot-long sections 26 suitable for combining into four extendible Z-studs.

Having completed a detailed description of the preferred embodiments of my invention so that those skilled in the art may practice the same, I contemplate that variations may be made without departing from the essence of the invention.

I claim:

1. A foldable metal channel comprising an elongate web and two substantially perpendicular elongate flanges adjoined to said web along two opposite elongate edges of said web, each of said flanges having a narrow slot formed therein, and said web having a raised rib formed therein, extending upwardly into said channel, said rib extending substantially perpendicularly of said flanges and across said web, said rib having a width in the elongate direction of said web which is sufficient to enable said web to be bent substantially 180°, said slots extending to the ends of said rib, each of said slots having a width where said flanges adjoin said web, and said widths of said slots and said rib being substantially equal.

2. A foldable metal channel as defined in claim 1, wherein said channel is about 3½ inches wide and said flanges are about 1-inch high.

3. A foldable channel as defined in claim 1, wherein said slots are about ⅛-inch wide and equal in length to the height of said flanges.

4. A foldable channel as defined in claim 1, wherein said slots are equal in length to the height of said flanges.

5. A foldable metal channel as defined in claim 1, wherein said channel is substantially 9-feet long and said slots and said rib divide said channel into two sections about 4½-feet long.

6. A folded metal channel, said folded channel being formed from a foldable metal channel as defined in claim 1, said folded metal channel having a web which is folded 180° onto itself along said rib.

7. A folded metal channel as defined in claim 6, wherein said folded channel is divided into two sections each about 4½-feet long.

8. A shipping package of a plurality of folded metal channels, each as defined in claim 7, wherein each said folded channel is divided into two equal length sections, forming a package of channels, said package being only half as long as an unfolded length of said folded channel, thereby providing ease in handling and shipping.

9. A shipping package comprising a plurality of folded metal channels as defined in claim 8, and a plurality of sections of expandable studs.

10. A shipping package as defined in claim 9, wherein said folded channel webs are about 3½-inch wide, said folded channel flanges are about 1-inch high, said package is about 4½-feet long, and consists essentially of two folded channels and eight expandable stud sections.

11. A wall framework comprising a foldable metal channel as defined in claim 1, affixed to a floor with vertical metal studs extending upwardly from said foldable metal channel.

12. A wall framework as defined in claim 11, further comprising another said foldable metal channel disposed over said studs and affixed to a ceiling and to said studs.

13. A foldable metal channel as defined in claim 1, wherein said slot in each of said flanges has a substantially constant width.

14. A foldable metal channel as defined in claim 1, wherein the thickness of said web and the thickness of said rib are substantially equal.

15. A foldable metal channel as defined in claim 1, wherein said slots and said rib are located at substantially the middle of said metal channel.

* * * * *